US007302923B2

(12) United States Patent
Hiraiwa

(10) Patent No.: US 7,302,923 B2
(45) Date of Patent: Dec. 4, 2007

(54) VARIABLE VALVE TIMING DEVICE ADAPTED FOR INTERNAL COMBUSTION ENGINE

(76) Inventor: Kazuyoshi Hiraiwa, 6-5-8 Tomioka-nishi, Kanazawa-ku Yokohama (JP) 236-0052

( * ) Notice: Subject to any disclaimer, the term of this patent is extended or adjusted under 35 U.S.C. 154(b) by 0 days.

(21) Appl. No.: 11/602,326

(22) Filed: Nov. 21, 2006

(65) Prior Publication Data

US 2007/0119400 A1 May 31, 2007

(30) Foreign Application Priority Data

Nov. 28, 2005 (JP) ..... 2005-341371

(51) Int. Cl.
*F01L 1/34* (2006.01)

(52) U.S. Cl. ..... 123/90.16; 123/90.39; 123/90.44

(58) Field of Classification Search ..... 123/90.16, 123/90.2, 90.27, 90.31, 90.6, 90.39, 90.44; 74/559, 567, 569
See application file for complete search history.

(56) References Cited

U.S. PATENT DOCUMENTS 7,240,649 B2 * 7/2007 Hara et al. ..... 123/90.16

FOREIGN PATENT DOCUMENTS

JP 11-107725 4/1999

* cited by examiner

*Primary Examiner*—Ching Chang
(74) *Attorney, Agent, or Firm*—Wenderoth, Lind & Ponack, L.L.P.

(57) ABSTRACT

A variable valve timing device includes a cam shaft, a rocker arm rotatably supporting the first roller and enabling a valve to be opened by a swing movement thereof when a first roller is pressed, a swing cam with a second cam surface, and an actuator for controlling the support shaft to move along a circular arc with a center at a center of the first roller in a valve-open state. The swing cam is swingable at a center of the support shaft, when a second roller is pressed by the cam shaft, so that the second cam surface presses the first roller. A contact position, between the first cam surface and the second roller, moves in a direction opposite to a rotational direction of the cam shaft when the support shaft is moved in a direction where a maximum lift amount of the valve becomes smaller.

8 Claims, 11 Drawing Sheets

VARIABLE VALVE TIMING DEVICE ADAPTED FOR INTERNAL COMBUSTION ENGINE

BACKGROUND OF THE INVENTION

1. Field of the Invention

The present invention relates to a variable valve timing device that is adaptable for an internal combustion engine and can continuously change open/close timing and a peak lift amount of an intake valve and/or an exhaust valve according to an operating state of an internal combustion engine installed on a motor vehicle.

2. Description of the Related Art

A conventional variable valve timing device of this kind is disclosed in Japanese patent laid-open publication No. (Tokkaihei) 11-107725. This conventional variable valve timing device includes a rocker-arm arranged between a drive cam and a swing cam so that the drive cam can drive the swing cam to be swung, where a position of a swing center of the rocker-arm can be changed by a control cam which swingably supports the swing cam at its swing center.

Another conventional variable timing device of this kind is disclosed in Japanese patent laid-open publication (Translation of PCT Application) No. (Tokkyokohyo) 2004-521234. In this conventional variable valve timing device, lift movement of a valve is controlled via a transmitting element by using a control track provided at a one end portion of a swing lever driven by a camshaft of an engine. The other end portion of the swing lever has a swing center point whose position is changeable by using an adjustment device.

The above known conventional variable valve timing devices, however, encounter a problem in that timing, corresponding to rotational phase of the cam shaft, when a valve-lift amount reaches a peak, hardly varies, although a valve-open range, corresponding to a rotational angle of a cam shaft between a valve-open angle and a valve-close angle, and a peak valve-lift amount can be continuously variable.

This causes delay of valve-open timing when the peak lift amount of the valve is set to be smaller. If the device is adapted for an intake valve, too long period causes between exhaust-valve-close timing and intake-valve-open timing.

In order to remove the above-mentioned problem, a timing adjusting device may be added to the variable valve timing device so as to advance the valve-open timing as the peak lift amount becomes smaller. Such the timing adjustment device is constructed to change a rotational phase between a cam shaft and a sprocket driving the cam shaft for example. Consequently, the peak lift amount and the timing are controlled at the same time, which encounters a problem in that the variable valve timing device with the timing adjustment device becomes complex, increasing its weight and manufacturing costs.

It is, therefore, an object of the present invention to provide a variable valve timing device, adapted for an internal combustion engine, which overcomes the foregoing drawbacks and can widely vary timing of a peak-lift position of a valve according to a peak lift amount of the valve and a change of valve-open region without an additional special timing adjusting device.

SUMMARY OF THE INVENTION

According to a first aspect of the present invention there is provided a variable valve timing device, adapted for an internal combustion engine, which includes a first roller, a second roller, a support shaft, a cam shaft formed thereon with a first cam surface, a rocker arm supporting the first roller and enabling a valve to be opened by a swing movement of the rocker arm when the first roller is pressed, a swing cam formed thereon with a second cam surface, and an actuator for controlling the support shaft. The swing cam is swingable at a center of the support shaft, when the second roller is pressed by the first cam surface of the cam shaft, so that the second cam surface presses the first roller. The actuator controls the support shaft to move along a circular arc with a center at a central axis of the first roller which is in a state where the valve is opened so that a contact position between the first cam surface of the cam shaft and an outer surface of the second roller moves in a direction opposite to a rotational direction of the cam shaft when the support shaft is moved in a direction where a maximum lift amount of the valve becomes smaller.

Therefore, the variable valve timing device can widely vary timing of a peak-lift position of a valve according to a peak lift amount of the valve and a change of valve-open region without an additional special timing adjusting device without any additional special device.

Preferably, the second roller and the support shaft are controlled to move so that, with respect to a line that is on a plane perpendicular to a central axis of the cam shaft and the central axis of the first roller, which is in the state where the valve is closed, and passes through the central axes of the cam shaft and the first roller, a movement locus of a center of the second roller is located at a side opposite to a direction where the cam shaft is rotated, and a movement locus of a center of the support shaft is located at the same side as the direction where the cam shaft is rotated.

Preferably, the support shaft is fixed on the swing cam and rotatably supports a third roller so that the third roller contacts with a guide surface of a guide member fixed to a stationary member.

Preferably, the support shaft is fixed on a support arm which is swingably supported on a stationary member at a center of the first roller.

Preferably, the support member is provided with a teeth portion which is engaged with a gear of the actuator.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
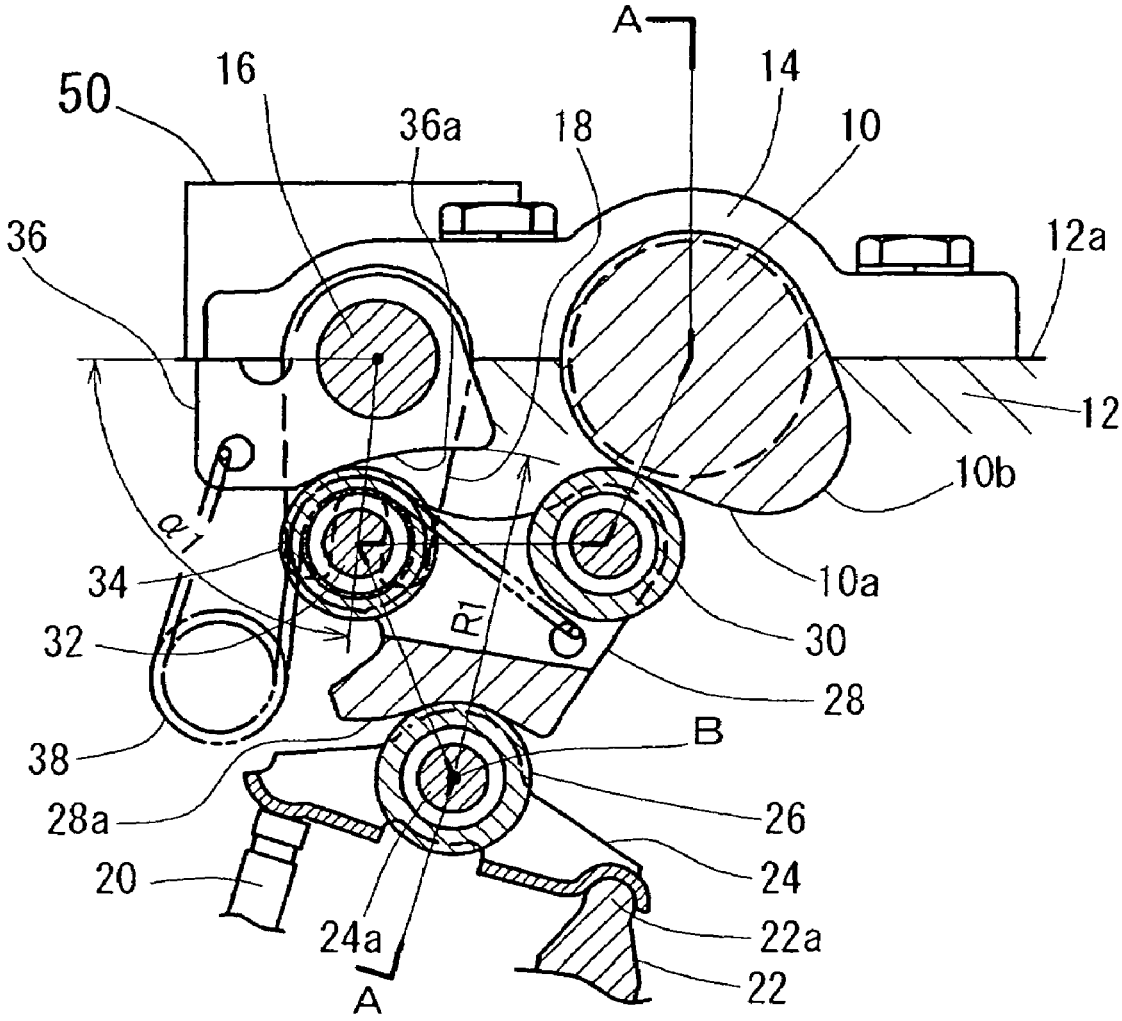
FIG. 1 is a cross-sectional view, taken along a line C-C in FIG. 2, showing a variable valve timing device of a first embodiment according to the present invention, the device being adapted to an intake valve of an internal combustion engine for a motor vehicle.

Throughout the following detailed description, similar reference characters and numbers refer to similar elements in all figures of the drawings, and their descriptions are omitted for eliminating duplication.

Figure 2:
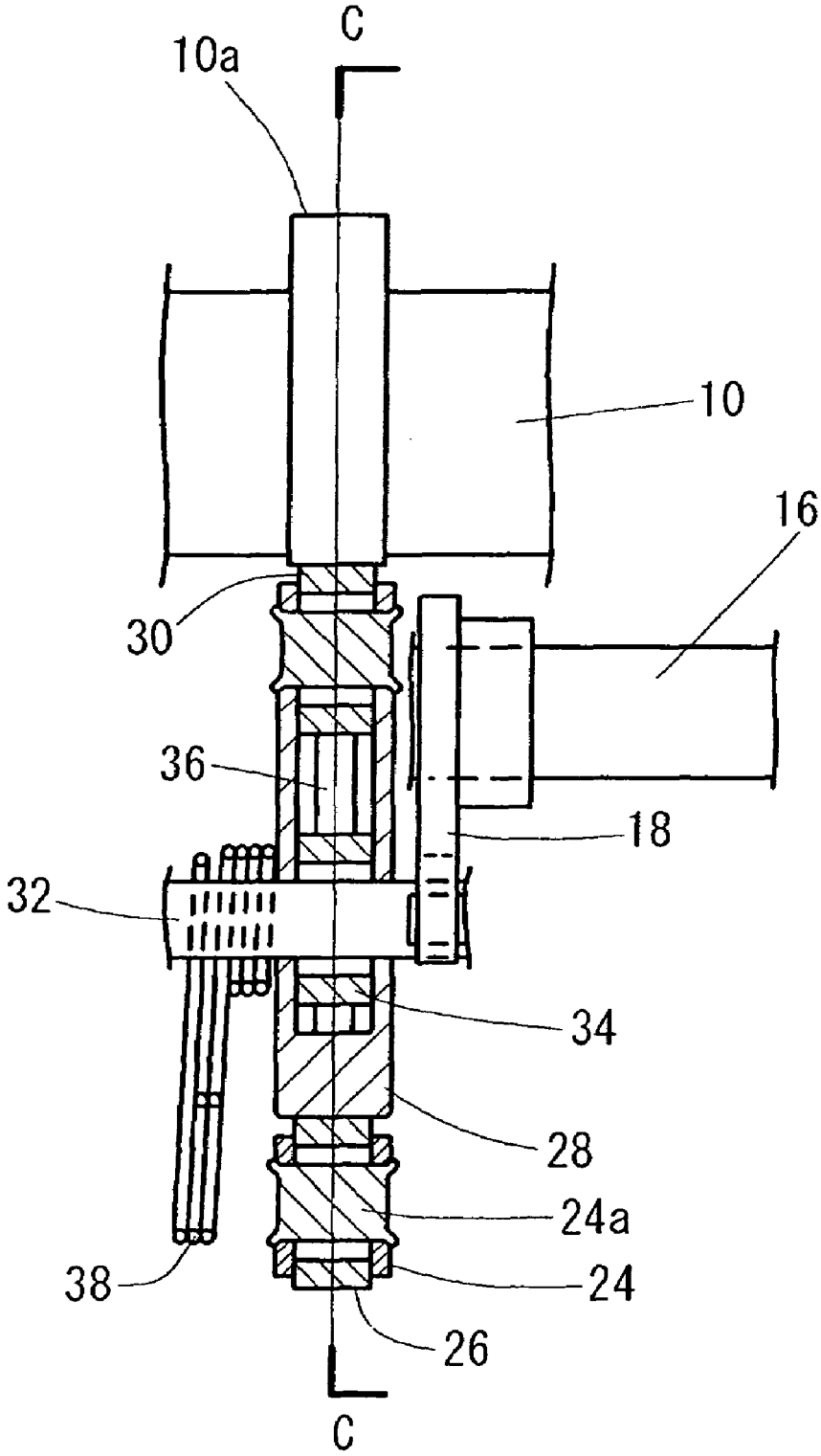
FIG. 2 is a development elevation taken along a line A-A in FIG. 1.

Referring to FIG. 1 and FIG. 2, there is shown a first preferred embodiment of a variable valve timing device according to the present invention.

A cam shaft 10 is rotatably supported by and between a cylinder head 12 of a not-shown internal combustion engine and a bracket 14 attached to a stationary surface 12*a* of the cylinder head 13 so that the cam shaft 12 is driven to rotate by a not-shown crank shaft of the engine. The cylinder head 12 corresponds to a stationary member of the present invention.

The cam shaft 10 has a first cam surface 10*a*, which is formed to have a profile with a top portion 10*b* similarly to that of conventional internal combustion engines.

A control shaft 16 is supported by and between the stationary surface 12*a* of the cylinder head 12 and the bracket 14, and is driven by an actuator 50 to rotate. The control shaft 16 has an extension portion provided with a support shaft 32.

A locker arm 24 is provided between an intake valve 20 and a lash adjuster 22, both provided on the cylinder head 12. Incidentally, the intake valve 20 and the lash adjuster 22, which are partially illustrated in FIG. 1, have constructions and configurations similar to those of conventional ones.

A first roller 26 is rotatably supported on the locker arm 24. There is provided with a not-shown bearing between the first roller 26 and a pin 24*a* integrally formed with the locker arm 24.

The lash adjuster 22 is fixed on the cylinder head 12, and is formed at its top portion with a ball portion 22*a*, which acts as a swing supporting point. The locker arm 24 can swing at the center of the ball portion 22*a*. When it swings in a counterclockwise direction, the intake valve 20 is moved from a state shown in FIG. 1 in a diagonally downward left direction in FIG. 1 so as to open the intake valve 20 in proportional to its swing angle.

The intake valve 20 is urged toward a diagonally upward right direction in FIG. 1 by elastic force of a not-shown spring, so that the intake valve 20 is moved to a position shown in FIG. 1 to close when the locker arm 24 does not press it.

A swing cam 28 is arranged between the cam shaft 10 and the locker arm 24. The swing cam 28 is formed on its bottom side with a second cam surface 28*a*. The swing cam 28 is provided with a support shaft 32 for rotatably supporting a third roller 34 at its one upper side and rotatably supports a second roller 30 at the other upper side thereof. The second roller 30 contacts with the first cam surface 10*a* of the cam shaft 10, the third roller 30 contacts with a guide surface 36*a* of a guide plate 36 fixed to the cylinder head 12, and the second cam surface 28*a* contacts with an outer surface of the first roller 26 rotatably supported by the rocker arm 24. The guide plate 36 corresponds to a guide member of the present invention.

The second roller 30 and the third roller 34 are rotatably supported by the swing cam 28 via a not-shown bearing, respectively, while the bearing of the third roller 34 is not indispensable.

As shown in FIG. 1, the guide surface 36*a* of the guide plate 36 is formed by a circular arc surface having a radius R1 from a center B at a center of the first roller 26 when the intake valve 20 is closed, and contacts with an outer surface of the third roller 34.

The third roller 34 is rotatably supported via the support shaft 34 by the control arm 18 fixed to the control shaft 16, so that the support shaft 32 can move along the guide surface 36*a* of the guide plate 36 according to a rotational movement of the control shaft 16 driven by the actuator 50. As shown in FIG. 2, the control arm 18 is located at a right side of the swing cam 28, which may be modified as follows. The control shaft 16 may be extended over the swing cam 28 toward a left side thereof, and be provided at its extended portion with another control cam so as to sandwich the third roller 34 with the control arm 18.

Figure 11:
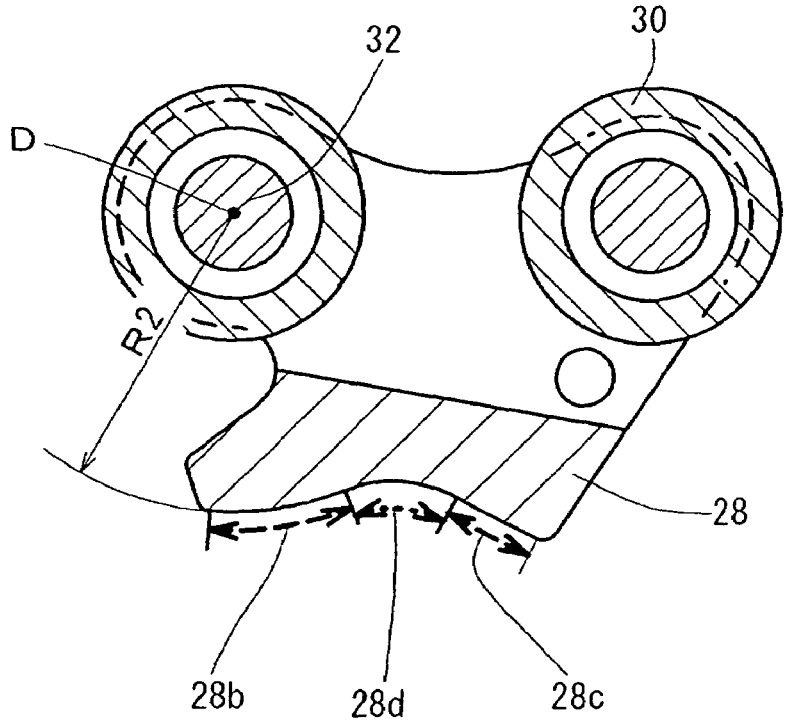
FIG. 11 is an enlarged cross-sectional view, taken along the line C-C in FIG. 2, of a swing cam used in the variable valve timing device shown in FIGS. 1 and 2.

As shown in FIG. 11, the second cam surface 28*a* includes a base curved portion 28*b*, a valve-open curved portion 28*c* and a ramp portion 30*d* connecting them. The base curved portion 28*b* is formed by a circular arc surface having a radius R2 from the center D of the support shaft 32. The base curved portion 28*b* is set to close the intake valve 20 when the first roller 26 contacts with the base curved portion 28*b*, which will be later described in detail.

A spring 38, illustrated by a chain double-dotted line in FIG. 1, is provided between the guide plate 36 and the swing cam 28 so that the swing cam 28 is always urged in a counterclockwise direction in FIG. 1 by elastic force of the spring 38. Specifically, one end portion of the spring 38 is inserted in and fixed to a hole portion of the guide plate 36 and the other end portion thereof is inserted in and fixed to a hole portion of the swing cam 28.

Accordingly, in addition to elastic force acting on the intake valve 20 toward its valve-close position by a not-shown valve-spring, the spring 38 always enables the second cam surface 28*a* of the swing cam 28 to be contacted with the outer surface of the first roller 26, and also enables the outer surfaces of the second roller 30 and the third roller 34 to be contacted with the first cam surface 10*a* of the cam shaft 10 and the guide surface 36*a* of the guide plate 36, respectively.

The operation of the variable valve timing device of the first embodiment will be described with reference to the accompanying drawings of FIGS. 3 to 5.

In the following description, the function of the variable timing valve of the present invention will be described, in some cases, with separating it into a "variable lift-amount" function and a "variable timing" function. In the former function a peak-lift-amount of the intake valve 20 varies, while in the latter function timing(s) of valve-open and/or valve-close varies (vary). Positions, or rotational phases, in a rotational direction of the cam shaft 10 and the control shaft 16 are respectively measured relative to the fixed surface 12*a* of the cylinder head 12 as a base surface.

Figure 3:
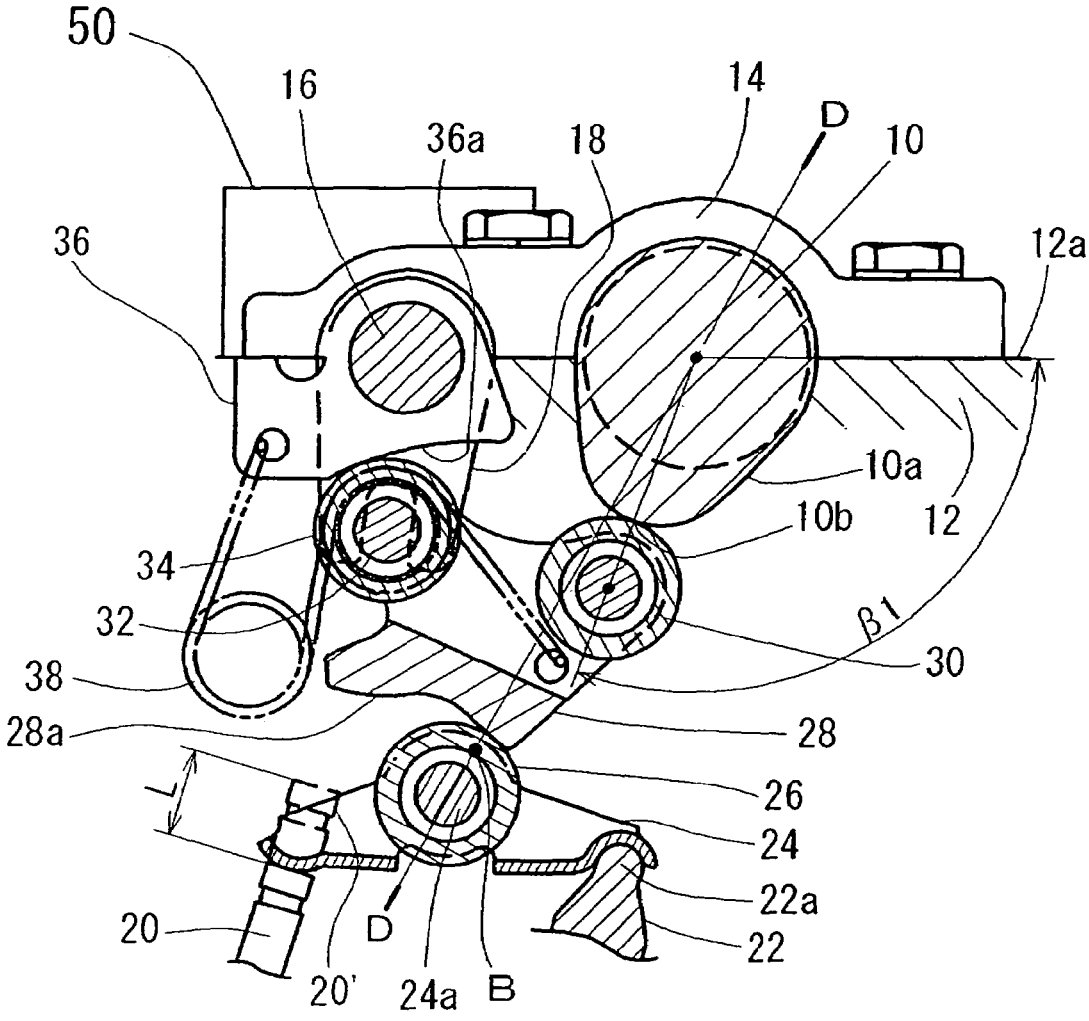
FIG. 3 is a cross-sectional view showing an operating state of the variable valve timing device shown in FIG. 1 when a rotational phase of a control shaft is an angle □1.

FIG. 1 shows a state where the control shaft 16 is located at an angle of □1 relative to the fixed surface 12*a*, that is, a position where the swing cam 28 is started to swing by a rotational movement, in a clockwise direction in FIG. 3, of the cam shaft 10.

In this state, the outer surface of the first roller 26 contacts with the base curved portion 28*b* of the swing cam 28*b*, thereby closing the intake valve 20.

When the cam shaft rotates from this state shown in FIG. 3 in the clockwise direction, the first cam surface 10*a* of the cam shaft 10 gradually presses down the second roller 30, consequently the support shaft 32 being swung in the clockwise direction in FIG. 1 at a central axis of the support shaft 32. This causes the ramp portion 28*d* of the second cam surface 28*a* formed on the swing cam 28 to press down the first roller 26, then the valve-open curved portion 28*c* thereof pressing down the first roller 26.

This causes the rocker locker arm 24 to be swung at the center of the ball portion 22*a* of the lash adjuster 22 in the counterclockwise direction, and thereby the intake valve 20 is pressed in the diagonally downward left direction to open. The moving amount of the intake valve 20 in this period corresponds to a lift amount of the intake valve 20.

FIG. 3 shows a state where the cam shaft 10 further rotates in the clockwise direction so that the top portion 10*b* of the first cam surface 10*a* contacts with the first roller 26, and consequently the swing cam 28 is moved by the largest amount in the clockwise direction, corresponding to a state where the intake valve 20 opens to provide the maximum opening area, that is, it is located at the maximum lift position.

The lift amount of this time is the maximum downward-moving amount, indicated by L, from a position of the intake valve 20', which is located at a closed state position and illustrated by a broken line. This state, where the top potion 10*b* of the first cam surface 10*a* contacts with the first roller 26 and its lift amount becomes the maximum amount L, is referred as a peak lift.

The cam shaft 10 further rotates in the clockwise direction from the state shown in FIG. 3, and consequently the swing cam 28 starts to reverse its swing direction, so that the swing cam 28 moves in the counterclockwise direction so as to return to the state shown in FIG. 1. This decreases the lift amount of the intake valve 20 to close the intake valve 20 as shown in FIG. 1. Specifically, the rotation, in the clockwise direction, of the cam shaft 10 enables the swing cam 28 to swing between the state shown in FIG. 1 and the state shown in FIG. 3. This brings the intake valve 20 to move between the state shown in FIG. 1 and the state shown in FIG. 3, repeating to open and close.

Incidentally, when the control shaft 16 and the support shaft 32 are located at a position, shown in FIGS. 1 and 3, of an angle of □1 shown in FIG. 1, the intake valve 20 is controllable so that the peak lift amount of the variable lift becomes the maximum lift amount. On the other hand, the rotational phase of the cam shaft 10 at the peak lift, as shown in FIG. 3, is at a position of an angle of □1, located between the stationary surface 12*a* and the top portion 10*b* of the first cam surface 10*a*.

Next, the variable lift control for decreasing the peak lift amount will be described.

Figure 4:
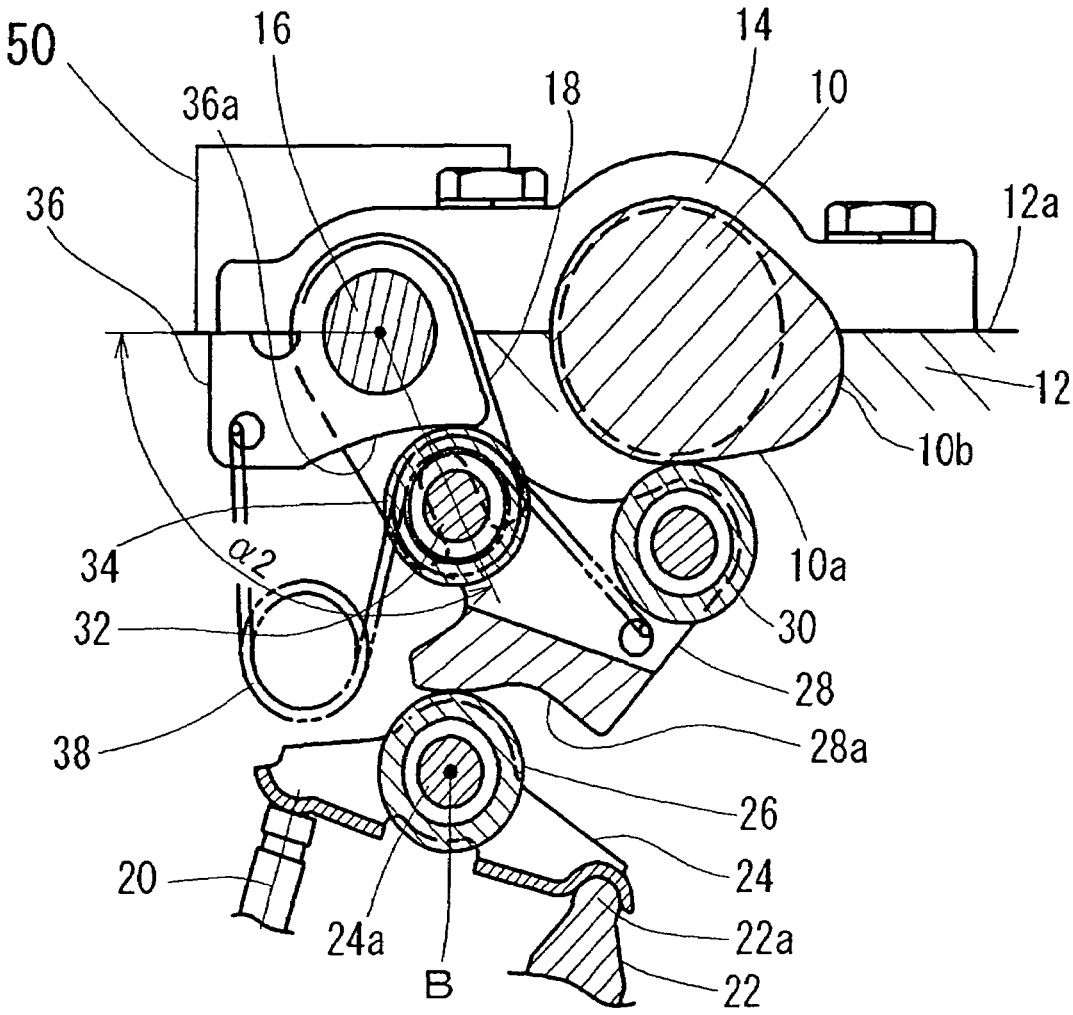
FIG. 4 is a cross-sectional view showing another operating state of the variable valve timing device shown in FIG. 1 when the rotational phase is an angle □2.
Figure 5:
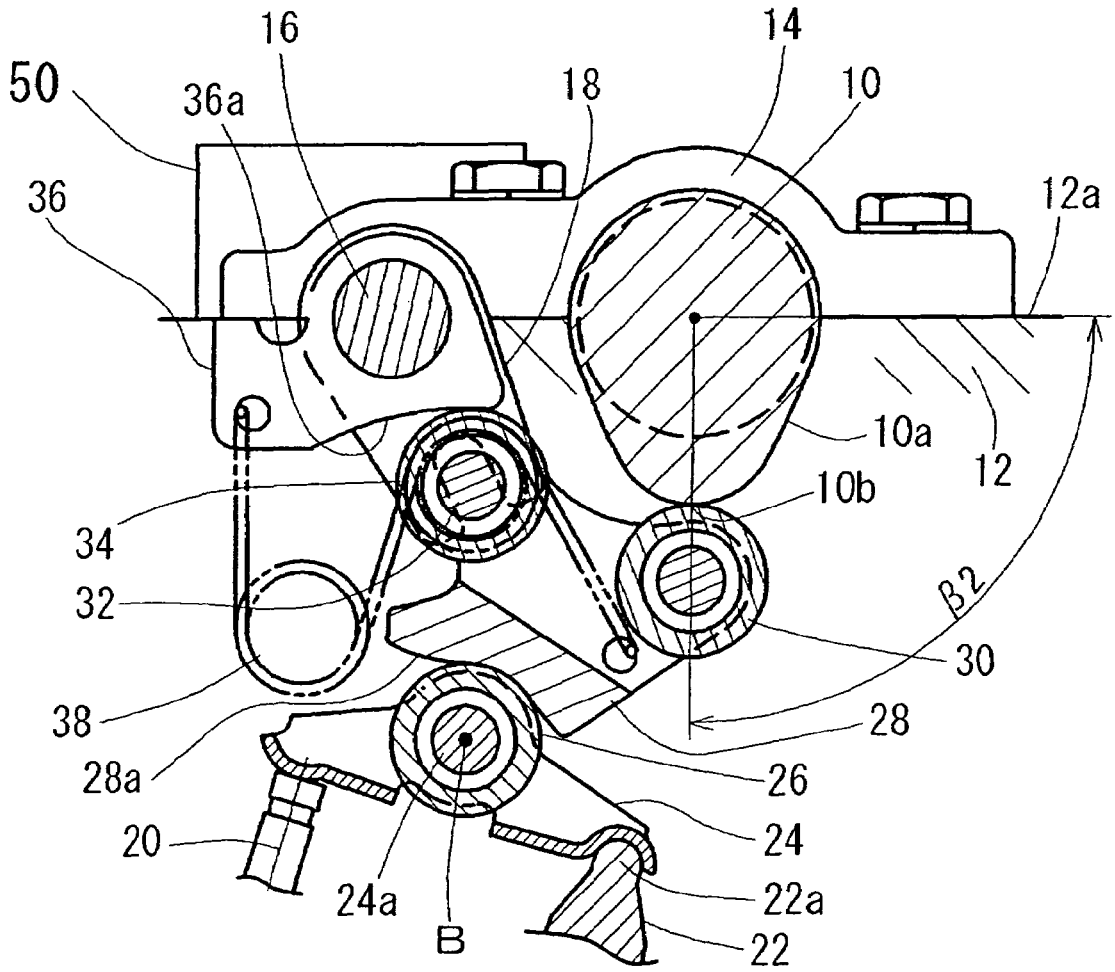
FIG. 5 is a cross-sectional view showing other operating state of the variable valve timing device when the rotational phase is an angle □2 and a cam shaft further rotates from a state shown in FIG. 4.

The control shaft 16 is rotated from the state shown in FIGS. 1 and 3 in the counterclockwise direction, which causes the position of the support shaft 32 to gradually approach the state shown in FIGS. 4 and 5. When the position of the support shaft 32 moves to the position (at an angle □2 in FIG. 4 relative to the stationary surface 12*a*) shown in FIGS. 4 and 5, the intake valve 20 is controllable so that the peak lift amount of the variable lift becomes the minimum lift amount. Specifically, the state shown in FIG. 4 corresponds to the state shown in FIG. 1 in that the swing cam 28 starts to swing when the cam shaft 10 is rotated in the clockwise direction. The swing cam 28 is swung in a state where it is rotated at the maximum amount in the counterclockwise direction. This is a state in which the control arm 18 is located at a rotational phase of the angle □2 (□2<□1) relative to the stationary surface 12*a* in FIG. 4, that is, being the maximum-angle rotated in the counter-clockwise direction. In this state, the first roller 26 contacts with the base curved portion 28*b* of the swing cam 28, thereby the intake valve 20 being closed similarly to that in FIG. 1.

The cam shaft 10 is further rotated from this state in the clockwise direction, and consequently the first cam surface 10*a* thereof gradually presses down the second roller 30. This causes the swing cam 28 to be swung in the clockwise direction. A contact point between the second cam surface 28*a* of the swing cam 28 and the outer surface of the first roller 26 is kept being on the base curved portion 28*b* to close the intake valve 20, even at a peak lift position where the top portion 10*b* of the first cam surface 10*a* contacts with the second roller 30 as shown in FIG. 5.

That is, at the position of the support shaft 32 shown in FIGS. 4 and 5, the intake valve 20 is kept being closed despite a swing movement of the swing cam 28 even when the cam shaft 10 is rotated. Therefore, the peak lift amount becomes zero in the variable lift control executed when the support shaft 38 is at the positions shown in FIGS. 4 and 5.

In the variable lift control, if the control shaft 16 is controlled so that the position of the support shaft 32 is located at the intermediate position between the position of the angle □1 (the states shown in FIGS. 1 and 3) and the position of the angle □2 (the states shown in FIGS. 4 and 5), the peak lift amount of the intake valve 20 becomes an intermediate lift amount between the lift amount shown in FIG. 3 and the lift amount shown in FIG. 5. Thus, changing the rotational phase of the control shaft 16 can continuously vary the peak lift amount of the intake valve 20.

As shown in FIGS. 4 and 5, when the control arm 18 is located at a rotational phase of the angle □2 relative to the stationary surface 12*a*, the peak lift amount becomes to be the maximum one when the top portion 10*b* of the first cam surface 10*a* is located at a position between the angle zero and the angle □2.

Although the lift amount of the intake valve 20 is set to be zero as described above, the rotational phase of the top portion 10*b* can change from the angle □1 to the angle □2. This changing amount between the angle □1 and the angle □2 continuously varies according to the rotational phase of the control shaft 16, similarly to the peak lift amount described above. That is, the rotational phase of the top portion 10*b* moves in a direction reverse to the rotational direction of the cam shaft 10 as the peak lift amount becomes smaller. In other words, the timing of the intake valve 20 becomes faster as the peak lift amount becomes smaller. These features are shown in FIG. 12.

Figure 12:
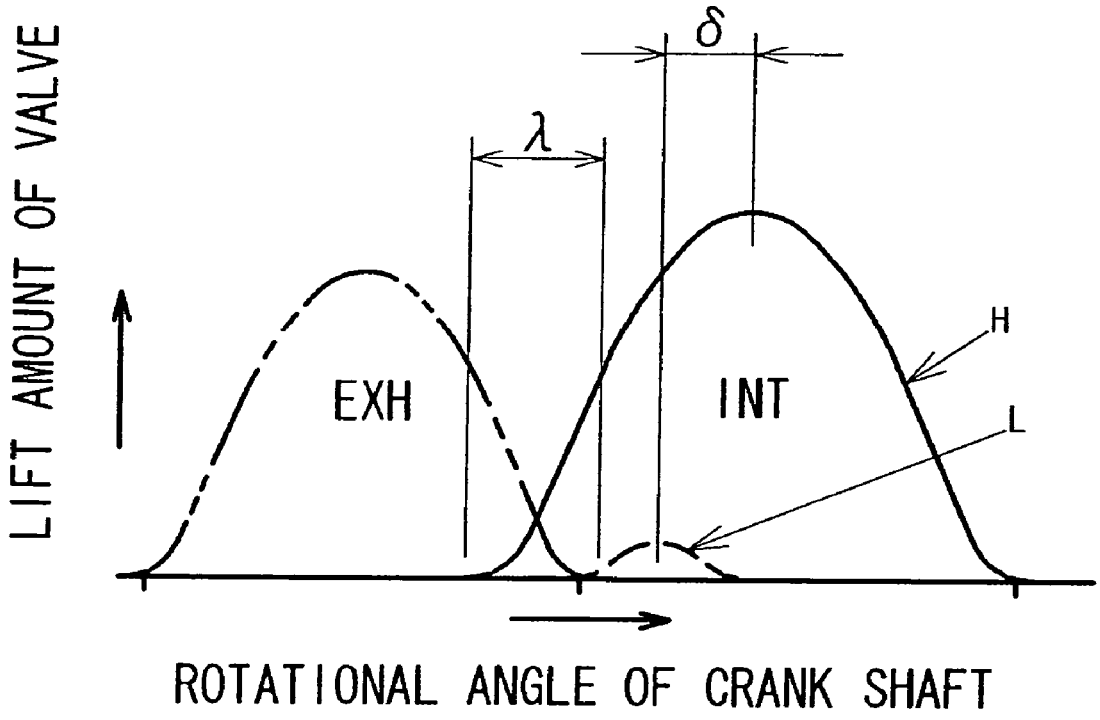
FIG. 12 is a diagram showing opening valve characteristics, between a rotation angle of a crank shaft and a lift amount of a valve when the variable valve timing device is operated.

FIG. 12 shows valve-open characteristics, including a characteristic in a case where the peak lift amount is the maximum one as shown in FIGS. 1 and 3, and a characteristic in a case where the rotational phase of the control shaft 16 is somewhat smaller than the angle □2 shown in FIG. 4, that is, the peak lift amount is very small. In FIG. 12, a horizontal axis indicates a rotational angle of the crank shaft of the internal combustion engine, which corresponds to the rotational phase (the rotational angle) of the cam shaft 10. The rotation of the cam shaft 10 is illustrated so that it moves from a left side toward a right side in FIG. 12. A vertical axis indicates a lift amount of the intake valve 20.

A line H indicates the maximum peak lift amount of the intake valve 20, and a broken line L indicates its smaller lift amount. In addition, in FIG. 12, the above-described mechanism and control of the intake valve 20 are not adapted for an exhaust valve in this embodiment, and accordingly a lift amount of the exhaust valve becomes a chain double-dashed line.

FIG. 12 shows that the timing of the peak lift is earlier by time of □ relative to the rotational phase of the cam shaft 10, moving by time □ toward the left side in FIG. 12, as the peak lift amount becomes smaller.

When the peak lift amount of the intake valve 20 is the maximum one, the lifts of the intake valve 20 and the exhaust valve are overlapped with each other, causing an overlapped period indicated by the crank angle □. Thus, the overlapped period decreases as the peak lift amount becomes smaller.

The variable valve timing device of the first embodiment can vary the valve-open timing according to the peak lift amount without using an additional special device for varying the timing of the valve. Accordingly, this variable valve timing device can be built by a simple structure, and can provide valve-open characteristics that can meet a need of an international combustion engine, decreasing its weight and manufacturing costs.

Incidentally, the valve-open timing characteristics are variable by changing geometric arrangement or layout of the cam shaft 10, the first roller 26, the second roller 30, and the support shaft 38.

The first embodiment shown in FIGS. 1 to 5 has features in that the second roller and the support shaft are controlled to move so that, with respect to a line (an alternate long and short dash line D-D in FIG. 3) that is on a plane perpendicular to a central axis of the cam shaft 10 and the central axis B of the first roller 26, which is in the state where the intake valve 20 is closed, and passes through the central axes of the cam shaft 10 and the first roller 26, a movement locus of a center of the second roller 30 is located at a side (a right side in FIG. 3) opposite to a direction where the cam shaft 10 is rotated, and a movement locus of a center of the support shaft 32 is located at the same side (a left side in FIG. 3) as the direction where the cam shaft 10 is rotated. These features provide a valve-open characteristic.

Next, a variable valve timing device, of a second embodiment according to the present invention, adapted for an internal combustion engine will be described with reference to the accompanying drawings of FIGS. 6 and 7.

Figure 6:
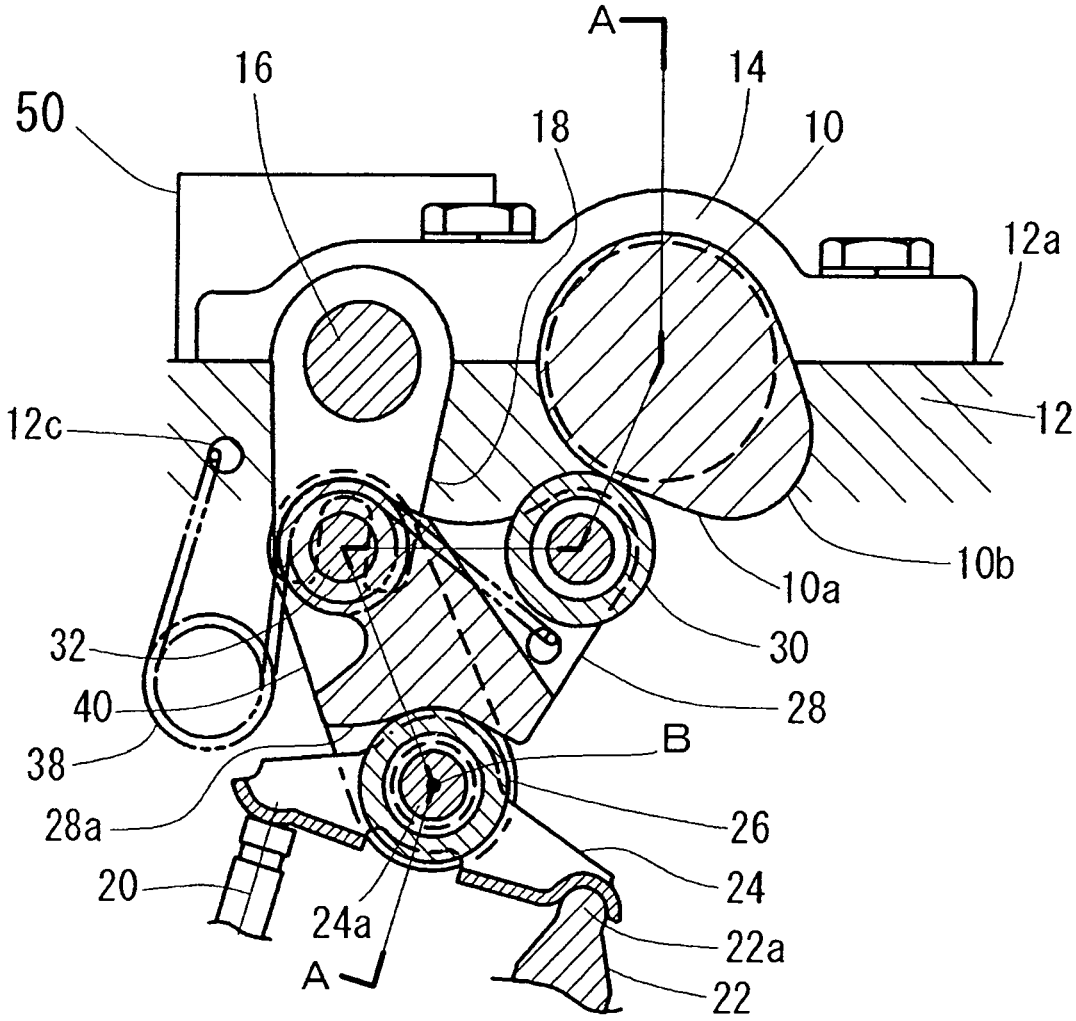
FIG. 6 is a cross-sectional view, taken along a line C-C in FIG. 7, showing a variable valve timing device of a second embodiment according to the present invention, the device being adapted to an intake valve of an internal combustion engine for a motor vehicle.
Figure 7:
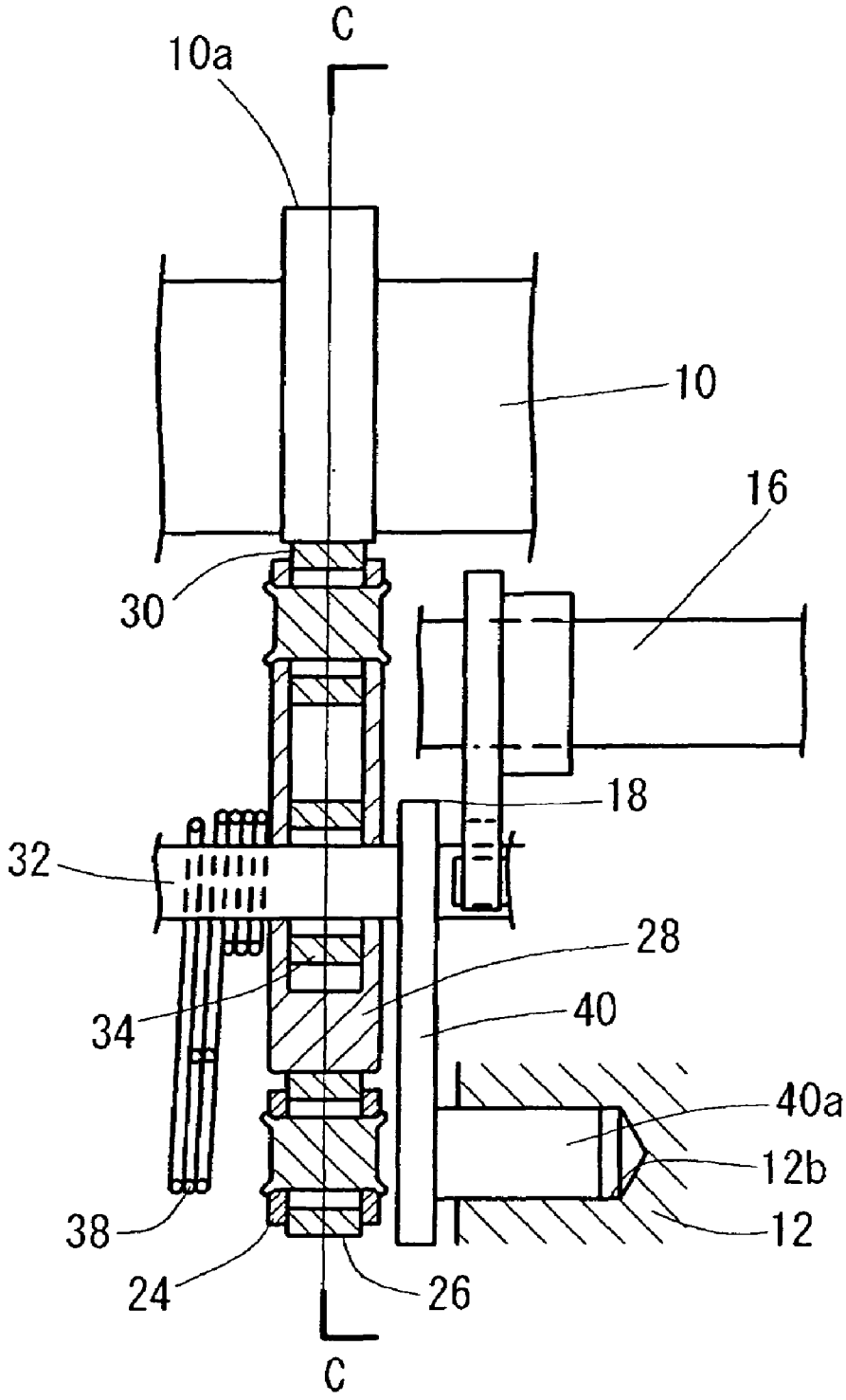
FIG. 7 is a development elevation taken along a line A-A in FIG. 6.

FIG. 6 corresponds to FIG. 1, and FIG. 7 corresponds to FIG. 2, although a supporting structure of a support shaft 32 in the second embodiment is different from the first embodiment.

In the second embodiment, a support arm 40 is provided to be swingable at a center of a swing shaft 40*a* which is integrally formed with the support arm 40 and rotatably inserted into a hole 12*b* of a cylinder head 12. The hole 12*b* is formed at a center B of a first roller 26 which is in a state where an intake valve 20 is closed.

Accordingly, in the second embodiment, the support shaft 32 can move along a circular arc at the center B of the first roller 26 when the intake valve 20 is closed, similarly to the operation of the first embodiment.

The guide plate 36 of the first embodiment shown in FIG. 1 is removed in the second embodiment. One end portion of a spring 38 is inserted in and fixed to a hole portion 12*c* of a cylinder head 12, instead of the hole portion of the guide plate 36 of the first plate. The other parts of the second embodiment are similar to those of the first embodiment, and their descriptions are omitted.

The operation of the variable valve timing device of the second embodiment, shown in FIGS. 6 and 7, is mainly similar to that of the first embodiment shown in FIGS. 1 to 5 except a supporting structure of the support shaft 32, and its description is omitted.

Therefore, the variable valve timing device of the second embodiment can change a variable valve-timing according to a valve lift-amount without an additional special device.

Next, a variable valve timing device, of a third embodiment according to the present invention, adapted for an internal combustion engine will be described with reference to the accompanying drawing of FIG. 8.

Figure 8:
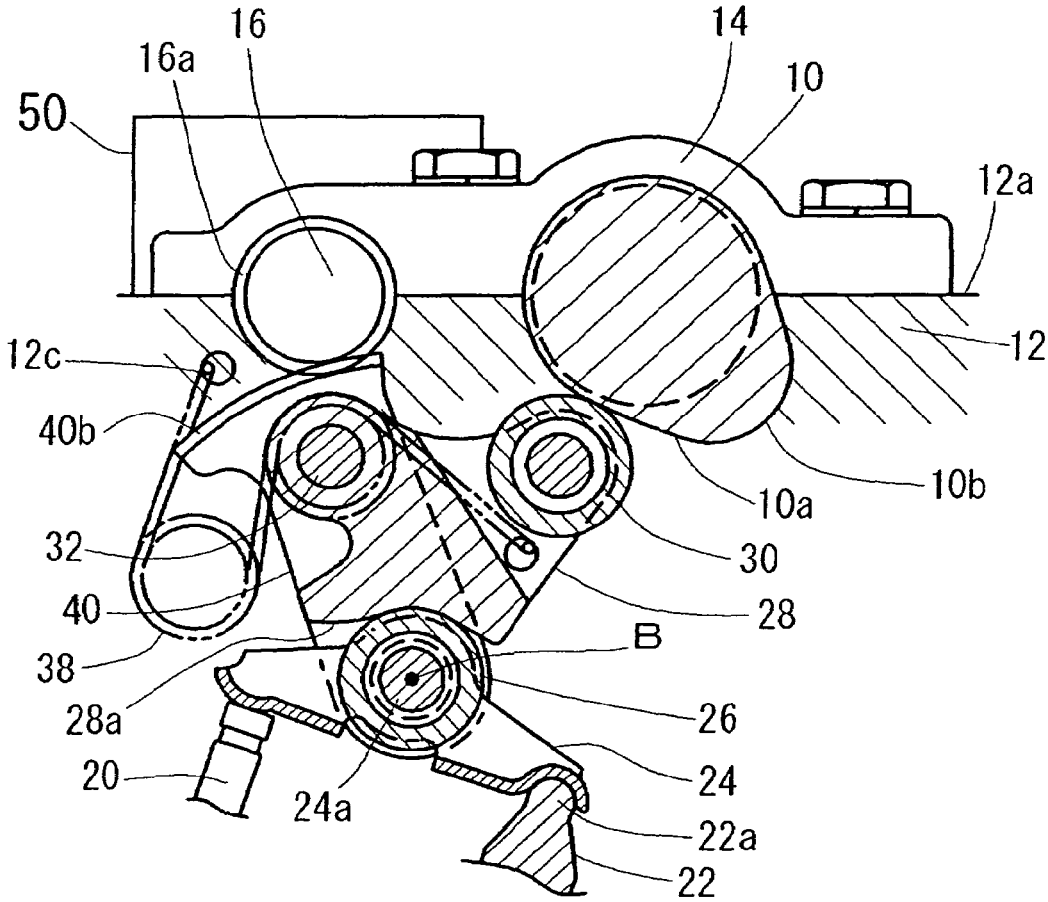
FIG. 8 is a cross-sectional view showing a variable valve timing device of a third embodiment according to the present invention, the device being adapted to an intake valve of an internal combustion engine for a motor vehicle.

FIG. 8 corresponds to FIG. 1 and FIG. 6, and a supporting structure of a support shaft 32 is similar to that of the second embodiment except a connecting structure of a control shaft 16 and a support arm 40.

A control shaft 16 is formed with a gear 16*a*, which is engaged with a teeth portion 40*b* formed on an upper outer portion of the support arm 40. Accordingly, a rotation movement of the control shaft 16 can change a position of the support shaft 32 by swinging the support arm 40. In the third embodiment, the support arm 40 can move along a circular arc at the center B of the first roller 26 when the intake valve 20 is closed, similarly to the operation of the first embodiment. The other parts of the third embodiment are similar to those of the second embodiment shown in FIGS. 6 and 7, and their descriptions are omitted.

The operation of the variable valve timing device of the third embodiment is similar to that of the first and second embodiments, except the supporting structure of the support shaft 32, and its description is omitted.

Therefore, the variable valve timing device of the third embodiment can change a variable valve-timing according to a valve lift-amount without an additional special device.

In the above-described embodiments, the swing cam 28 may be modified as follows.

Figure 9:
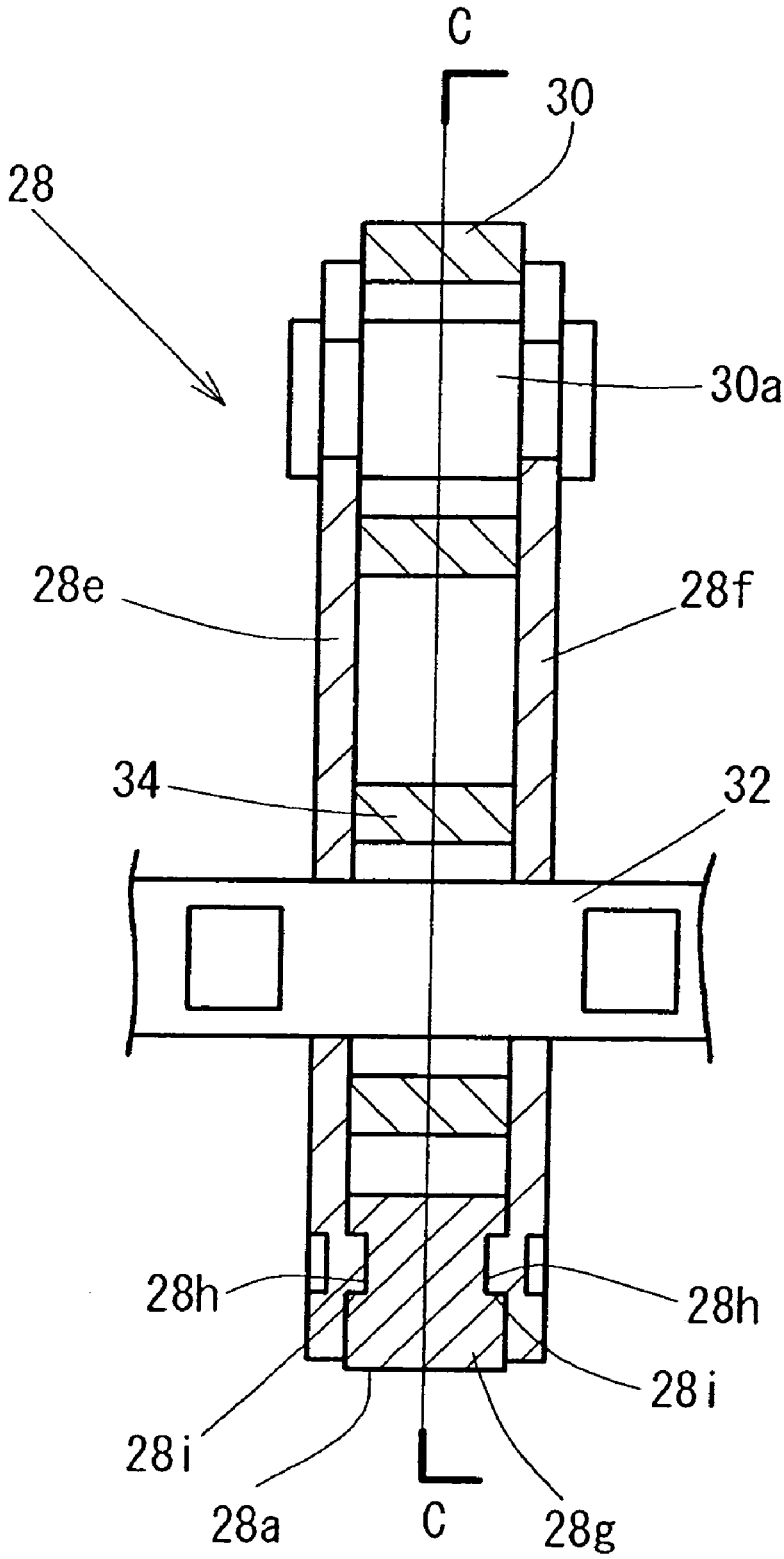
FIG. 9 is an enlarged cross-sectional view showing a modification of a swing cam used in the first to third embodiments.
Figure 10:
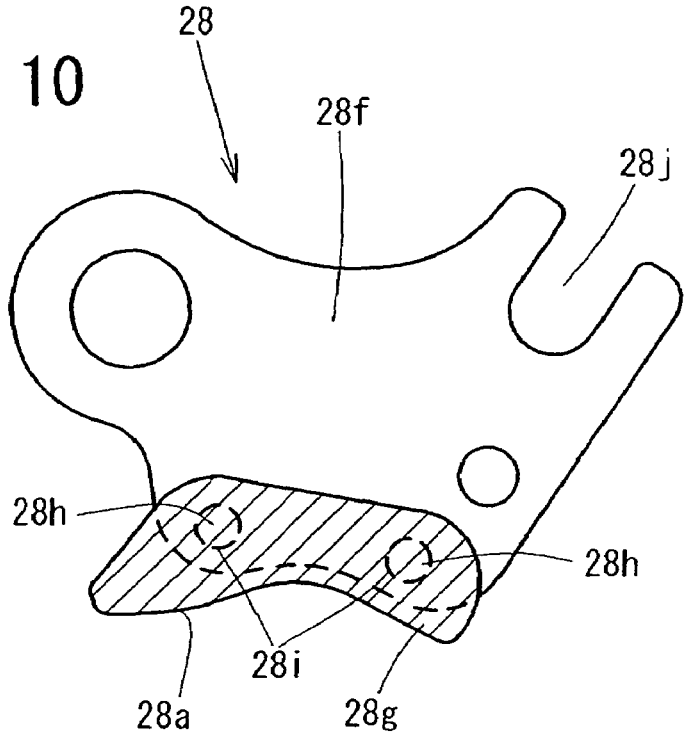
FIG. 10 is a cross sectional view of the swing cam shown in FIG. 9.

FIG. 9 and FIG. 10 show a modification of the swing cam 28. The swing cam 28 has a pair of plates 28*e* and 28*f* and a cam plate 28*g*, which are joined with one another as shown in FIG. 9. They are preferably joined by caulking or welding. Specifically, the cam plate 28*g* and the plates 28*e* and 28*f* are located with respect to one another by using two projections 28*h* formed on inner surfaces of the plates 28*e* and 28*f* and two holes 28*i*, for receiving the projections 28*h*, formed on the cam plate 28*g*, and then they are welded to one another.

Incidentally, a second roller 30 is rotatably supported by the plates 28*e* and 28*f* by using a shaft 30*a* thereof being inserted into cut-off portions 28*j*, one of which is shown in FIG. 10, of the plates 28*e* and 28*f*.

Therefore, the swing cam 28 can be manufactured easily and at low costs, because the plates.

While there have been particularly shown and described with reference to preferred embodiments thereof, it will be understood that various modifications may be made therein, and it is intended to cover in the appended claims all such modifications as fall within the true spirit and scope of the invention.

One variable valve timing device is used for one valve in the embodiments, while one support shaft 32 and the control arm 32 can be used for a plurality of valves.

In a case where one cylinder is provided with two valves, the control arms 18 are provided for two intake valves, respectively, and the control shaft 16 and two control arms 18 may be joined with one another so that rotational phases of the control arms 18 are set to be different in a rotational direction of the control shaft 16. This can provide different valve-open characteristics between the two intake valves in one cylinder.

In this case, when the internal engine is operated at low load, where the peak lift amount is small, the intake valves can be controlled so that one of the valves is kept closed and the other of them is kept within a small lift amount. This setting is desirable for an internal combustion engine adapted for a motor vehicle in order to improve its fuel consumption efficiency and exhaust-gas purification efficiency.

The first cam surface 10 of the cam shaft 10 and the second cam surface 28*a* of the swing cam 28 may be formed to have a desirable cam profile different from those of the embodiments, and/or a desirable control characteristic according to an operation of an internal combustion engine.

Although the variable valve timing device is adapted only for the intake valve 20 in the embodiments, it is adaptable for an exhaust valve to vary its lift amount and valve-timing.

The entire contents of Japanese Patent Application No. 2005-341371 filed Nov. 28, 2005 are incorporated herein by reference.

What is claimed is:

1. A variable valve timing device adapted for an internal combustion engine comprising:

a first roller;

a second roller;

a support shaft;

a cam shaft formed thereon with a first cam surface;

a rocker arm rotatably supporting the first roller and enabling a valve to be opened by a swing movement of the rocker arm when the first roller is pressed;

a swing cam formed thereon with a second cam surface, the swing cam being swingable at a center of the support shaft, when the second roller is pressed by the first cam surface of the cam shaft, so that the second cam surface presses the first roller; and an actuator for controlling the support shaft to move along a circular arc with a center at a central axis of the first roller which is in a state where the valve is opened, wherein a contact position between the first cam surface of the cam shaft and an outer surface of the second roller moves in a direction opposite to a rotational direction of the cam shaft when the support shaft is moved in a direction where a maximum lift amount of the valve becomes smaller.

2. The variable valve timing device according to claim 1, wherein the second roller and the support shaft are controlled to move so that, with respect to a line that is on a plane perpendicular to a central axis of the cam shaft and the central axis of the first roller, which is in the state where the valve is closed, and passes through the central axes of the cam shaft and the first roller, a movement locus of a center of the second roller is located at a side opposite to a direction where the cam shaft is rotated, and a movement locus of a center of the support shaft is located at the same side as the direction where the cam shaft is rotated.

3. The variable valve timing device according to claim 2, wherein the support shaft is fixed on the swing arm and rotatably supports a third roller so that the third roller contacts with a guide surface of a guide member fixed to a stationary member.

4. The variable valve timing device according to claim 2, wherein the support shaft is fixed on a support arm which is swingably supported on a stationary member at a center of the first roller.

5. The variable valve timing device according to claim 4, wherein the support member is provided with a teeth portion which is engaged with a gear of the actuator.

6. The variable valve timing device according to claim 1, wherein the support shaft is fixed on the swing arm and rotatably supports a third roller so that the third roller contacts with a guide surface of a guide member fixed to a stationary member.

7. The variable valve timing device according to claim 1, wherein the support shaft is fixed on a support arm which is swingably supported on a stationary member at a center of the first roller.

8. The variable valve timing device according to claim 7, wherein the support member is provided with a teeth portion which is engaged with a gear of the actuator.

* * * * *